US008651340B2

(12) United States Patent
Lelieveld et al.

(10) Patent No.: US 8,651,340 B2
(45) Date of Patent: Feb. 18, 2014

(54) FLUID RESERVOIR FOR A HANDHELD DEVICE FOR PERSONAL CARE

(75) Inventors: Mark Lelieveld, Drachten (NL); Gerben Raap, Drachten (NL); Jan Bennik, Drachten (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/395,753

(22) PCT Filed: Aug. 11, 2010

(86) PCT No.: PCT/IB2010/053628

§ 371 (c)(1), (2), (4) Date: Mar. 13, 2012

(87) PCT Pub. No.: WO2011/036577

PCT Pub. Date: Mar. 31, 2011

(65) Prior Publication Data

US 2012/0167393 A1 Jul. 5, 2012

(30) Foreign Application Priority Data

Sep. 22, 2009 (EP) ..... 09170970

(51) Int. Cl.

*B65D 88/54* (2006.01)
*B65D 35/28* (2006.01)
*B67D 7/60* (2010.01)

(52) U.S. Cl.

USPC ..... 222/336; 222/95; 222/386.5

(58) Field of Classification Search

USPC ..... 222/92, 94, 95, 105, 212, 213, 214, 222/386.5, 336, 340, 386, 325, 326, 389, 222/256–263

See application file for complete search history.

(56) References Cited

U.S. PATENT DOCUMENTS

| | | | | |
|---|---|---|---|---|
| 2,327,192 | A | | 8/1943 | Keene |
| 2,471,852 | A | * | 5/1949 | Bau ..... 222/95 |
| 3,008,746 | A | * | 11/1961 | Senger ..... 293/134 |
| 3,189,231 | A | * | 6/1965 | Kibbel, Jr, et al. ..... 222/389 |
| 3,308,818 | A | * | 3/1967 | Rutkowski ..... 604/69 |
| 3,756,476 | A | * | 9/1973 | Bonduris ..... 222/386.5 |
| 3,876,115 | A | * | 4/1975 | Venus et al. ..... 222/183 |
| 4,077,119 | A | | 3/1978 | Sellera |
| 4,113,151 | A | * | 9/1978 | Brown et al. ..... 222/324 |
| 4,877,157 | A | * | 10/1989 | Saulle ..... 222/387 |
| 2008/0016692 | A1 | | 1/2008 | Noble |
| 2008/0172879 | A1 | | 7/2008 | Salvatore |

FOREIGN PATENT DOCUMENTS

| | | | |
|---|---|---|---|
| WO | 2004007289 | A1 | 1/2004 |
| WO | 2005056250 | A2 | 6/2005 |
| WO | 2008088739 | A1 | 7/2008 |

* cited by examiner

*Primary Examiner* — Kevin P Shaver
*Assistant Examiner* — Stephanie E Williams

(57) ABSTRACT

A fluid reservoir for storing a fluid for a handheld device includes a housing and a flexible membrane. The flexible membrane delimits a variable storage volume in the housing. The storage volume may be varied by a defamation of the membrane. The variable storage volume has an output port. The fluid reservoir further includes a forcing member to exert a force on the membrane to pressurize a fluid in the storage volume. The forcing member has a recess for receiving a part of the storage volume. The membrane may be received into the recess of the forcing member during a compression stroke. By virtue thereof, a volume defined by the recess may be effectively used to become part of the storage volume for the fluid.

15 Claims, 3 Drawing Sheets

FLUID RESERVOIR FOR A HANDHELD DEVICE FOR PERSONAL CARE

FIELD OF THE INVENTION

The present invention relates to a fluid reservoir for a handheld device for personal care. The fluid reservoir is arranged for storing a fluid. The fluid may e.g. be a skin care additive, like a cleaning agent, a lubricating agent etc. that enhance a process corresponding to the handheld device, e.g. a shaving process. The handheld device for personal care may e.g. be a shaving device, a trimmer, a massage tool or a tooth brush.

BACKGROUND OF THE INVENTION

From WO2005/056250 a shaving apparatus is known. The shaving apparatus includes a razor cartridge having one or more razor blades, a housing, a flexible bladder, a handle having an interior cavity and an actuator. The housing includes an exterior surface that is adjacent the razor cartridge and includes one or more ports. The housing is attached to an open end of the flexible bladder such that the one or more ports are in fluid communication with the contents of the flexible bladder. The flexible bladder stores a flowable shaving aid material and is disposed within an interior cavity in the handle. The flexible bladder has a shape that is complementary to the shape of the interior cavity in the handle. The actuator is operable to collapse the flexible bladder, thereby forcing the flowable shaving aid material from the flexible bladder to the one or more ports. Once the flowable shaving aid material exits the ports, it is dispensed on the surface being shaved adjacent the razor cartridge.

A problem of the known shaving apparatus is that the assembly for dispensing fluid occupies a large volume in the shaving apparatus.

OBJECT OF THE INVENTION

It is an object of the present invention to at least partially eliminate the above mentioned drawbacks and/or to provide a useable alternative. In particular, it is an object of the invention to provide a compact fluid reservoir.

SUMMARY OF THE INVENTION

This object is achieved by a fluid reservoir as defined in claim 1. The fluid reservoir according to the invention is suitable for storing a fluid for a handheld device for personal care. Such a handheld device for personal care, in particular a handheld skincare device, may for instance be a shaving apparatus, a single use razor, a trimmer, a massage tool or a tooth brush. The handheld device may have a replaceable fluid reservoir, such as a cartridge, or an incorporated fluid reservoir. The fluid reservoir comprises a housing. The housing is preferably longitudinal and has preferably at least partially a tubular shape.

The fluid reservoir further comprises a flexible membrane. The membrane is flexible in that it is able to deform by stretching, bending etc. due to an exerted force during use of the fluid reservoir. The flexible membrane may be fixed to an inner wall of the housing. Preferably, the membrane has a substantially circular cross section, wherein an outer edge of the membrane may be fixed to a cylindrical inner wall of the housing. The flexible membrane delimits a variable storage volume in the housing. The storage volume may be varied by a deformation of the membrane.

The variable storage volume has an output port. The output port is in fluid communication with the storage volume for dispensing the fluid.

The fluid reservoir according to the invention further comprises a forcing member. The forcing member exerts a force on the membrane to pressurize a fluid in the storage volume. The forcing member may be compressible over a stroke, a compression stroke. Advantageously, the forcing member has a recess for receiving a part of the storage volume. A pressurized fluid in the storage volume may exert a pressure on the membrane which deforms the membrane and pushes a part of the membrane into the recess. The membrane is deformable in that the membrane deforms due to a fluid pressure in the storage volume. The flexible membrane may be received into the recess of the forcing member during the compression stroke. The recess in the forcing member has a recess depth. The membrane may be introduced into the recess until the membrane finally reaches the recess depth. A fully introduced membrane in the recess together with the storage volume above the membrane may define a maximum storage volume. Thus, a volume defined by the recess may be effectively used to become part of the storage volume for the fluid. The recess may e.g. enlarge the maximum storage volume by at least 5%, in particular at least 10%, but preferably at least 20%. The recess may have a recess depth which is at least 1/10 of the total height of the forcing member, in particular at least 1/5 of the total height of the forcing member, but more in particular at least 1/2 of the total height of the forcing member. Advantageously, the configuration of the fluid reservoir may be made very compact, which allows a space efficient integration of the fluid reservoir into a handheld device. From another point of view, the fluid reservoir according to the invention enables more fluid to be stored as compared to prior art fluid reservoirs.

In an embodiment of the fluid reservoir according to the invention, the forcing member may be an actuator, e.g. an electronic or pneumatic actuator. The actuator may be spindle driven. The actuator may be a telescopic actuator. Advantageously, the actuator may provide a substantially constant force on the membrane. Advantageously, the pressing force may be controlled such that the fluid is dispensed under a substantially constant pressure, which may result in a constant volume flow of fluid independent of the remaining fluid in the storage volume. The actuator may be accurately controlled to obtain sufficient force for dispensing the fluid out of the storage volume in a desired volume flow.

In an embodiment of the fluid reservoir according to the invention, the forcing member is a biasing member. Besides the compact configuration, a further advantage may be obtained. When the storage volume is being emptied, the membrane may provide advantageously a more constant pressure on the fluid in the storage volume. Since the membrane is at least partially movable into the recess of a forcing member; it may become possible to reduce the total compression stroke of the forcing member. A smaller compression stroke may result in a less reducing pre-tension of the biasing member. By virtue thereof, advantageously, the pressure in the storage volume remains more constant during the compression stroke. This advantage will be further elucidated by the accompanying drawings.

In an embodiment of the fluid reservoir according to the invention, the biasing member may be a coil spring. The coil spring may be made from steel, preferably stainless steel. The coil spring has a central through hole which defines the recess of the biasing member. Advantageously, the recess has a height which equals the total height of the biasing member to obtain a maximum increase of the storage volume. The housing may be longitudinal and cylindrical, wherein the coil spring fits in a bottom region of the housing. The housing may have a bottom part as a support face which may be closed or may comprise an inner ring surface to support the coil spring in the housing. The coil spring has a free end which is movable inwards and outwards. The free end of the coil spring may be covered by the flexible membrane. The membrane defines a storage volume above the membrane. In assembly, the coil spring has a first extreme position and a second extreme position. The coil spring is more compressed in the first position than in the second position, said first and second position respectively correspond with a filled fluid reservoir and an emptied fluid reservoir. In the first position, a central part of the membrane is moved inwards the through hole of the coil spring. In the second position the central part of the membrane is moved outwards the through hole of the coil spring. Thus, the central part of the membrane can move over a stroke which may be twice as long as the compression stroke of the coil spring. Advantageously, the smaller compression stroke has a smaller variation in pre-tension, which may give a more regular dispensing of the fluid over the whole stroke.

Preferably, the flexible membrane deforms from the first to the second position due to substantially a rolling mechanism instead of a stretching mechanism. As a result, the membrane may be less susceptible to wear. This advantageously elongates the lifetime of the membrane. Further, the rolling mechanism of the membrane may generate a relatively low friction.

In an alternative embodiment of the fluid reservoir according to the invention, the biasing member may be a resilient body. The resilient body may be made from an elastomeric material, such as a rubber. The resilient body is compressible over a compression stroke. The resilient body may have a cylindrical shape. The resilient body may be supported by a support face of the housing at a bottom region and may have a free end. The resilient body has a recess at its free end for receiving a part of the membrane.

In an embodiment of the fluid reservoir according to the invention, the flexible membrane may be fixed to an inner wall of the housing. The membrane may be vulcanized or glued to the housing. Advantageously, the fluid reservoir may have an improved sealing and may be a closed system, wherein no water or air can enter the storage volume. The improved sealing may result in a longer storage life of the fluid. Additionally, in comparison with a piston-shaped forcing member, the fixation of the flexible membrane to the inner wall may reduce any friction occurring during use.

Preferably, the membrane has a circular cross section. The membrane may have an outer edge to connect the membrane to the housing. Preferably, the housing has a tubular inner wall for connecting the membrane, wherein the inner wall has a substantially circular cross section. By virtue thereof, a storage volume at one side of the membrane is delimited in the housing, wherein the biasing member is arranged at the opposite side of the membrane. The membrane may have a cylindrical shape with a closed top and an open bottom. The cylindrical shape may have a slight inclination. The membrane may be flexible, allowing the closed top to be flipped inwards and outwards to vary the storage volume.

In an embodiment of the fluid reservoir according to the invention, an output port for dispensing fluid is positioned opposite the membrane. The output port may be closable by a valve. The valve may be manually or electrically actuated. An actuator may be provided to operate the valve. The actuator may comprise a button, a rotary or sliding knob to open or close the output port. Advantageously, the membrane moves towards the output port when the storage volume is being emptied, which may give a relatively low flow resistance.

In an embodiment of the fluid reservoir according to the invention, the housing comprises an input port for re-filling the fluid reservoir. By virtue thereof, the fluid reservoir may become suitable for being used multiple times, which may be more friendly for the environment. The input port may be situated at an exterior outer surface of the housing adjacent the output port of the storage volume. Advantageously, the input port may be well accessible from the outside when the fluid reservoir is implemented in a handheld device. Removing the fluid reservoir for filling may be unnecessary as a result of this configuration.

In an embodiment of the fluid reservoir according to the invention, a connector organ may be provided at the input port for connecting a refill reservoir. The connector organ may be a threaded portion which allows a simple connection of a refill reservoir. A passage channel may be provided which is in fluid communication with the storage volume and the input port to obtain a well accessible position for connecting the refill reservoir.

In a particular embodiment of the fluid reservoir according to the invention, the fluid reservoir may be integrated into a handle of a handheld device. The handle may be arranged for holding the handheld device, e.g. a shaving apparatus, by hand. The handle may have a compartment for receiving the fluid reservoir as a cartridge. The fluid reservoir may e.g. be a removable cartridge for a shaving apparatus. Alternatively, the compartment may be configured as a housing for integrating the fluid reservoir in the handle. The housing of the fluid reservoir may be formed by the compartment which advantageously does not require an additional housing anymore.

Further, the invention relates to a handheld device, in particular a handheld skincare device. The handheld device is for example an electrical shaving apparatus, or a manual single-use razor tool, a trimmer, a massage tool, a toothbrush etc. The handheld device includes a fluid reservoir or is arranged to receive a removable fluid reservoir. The fluid may be a liquid or a cream. The fluid may include a shaving lubricant, a drag-reducing agent, a depilatory agent, a cleaning agent, etc to enhance the corresponding process of the handheld device.

Further preferred embodiments are defined in the subclaims.

BRIEF DESCRIPTION OF THE DRAWINGS

The invention will be explained in more detail with reference to the appended drawings. The drawings show a practical embodiment according to the invention, which should not be interpreted as limiting the scope of the invention. Specific features may also be considered apart from the shown embodiment and may be taken into account in a broader context as a characterizing feature, not only for the shown embodiment but as a common feature for all embodiments falling within the scope of the appended claims.

In the drawings.

DETAILED DESCRIPTION OF EXAMPLES

Figures 1A, 1B, 1C:
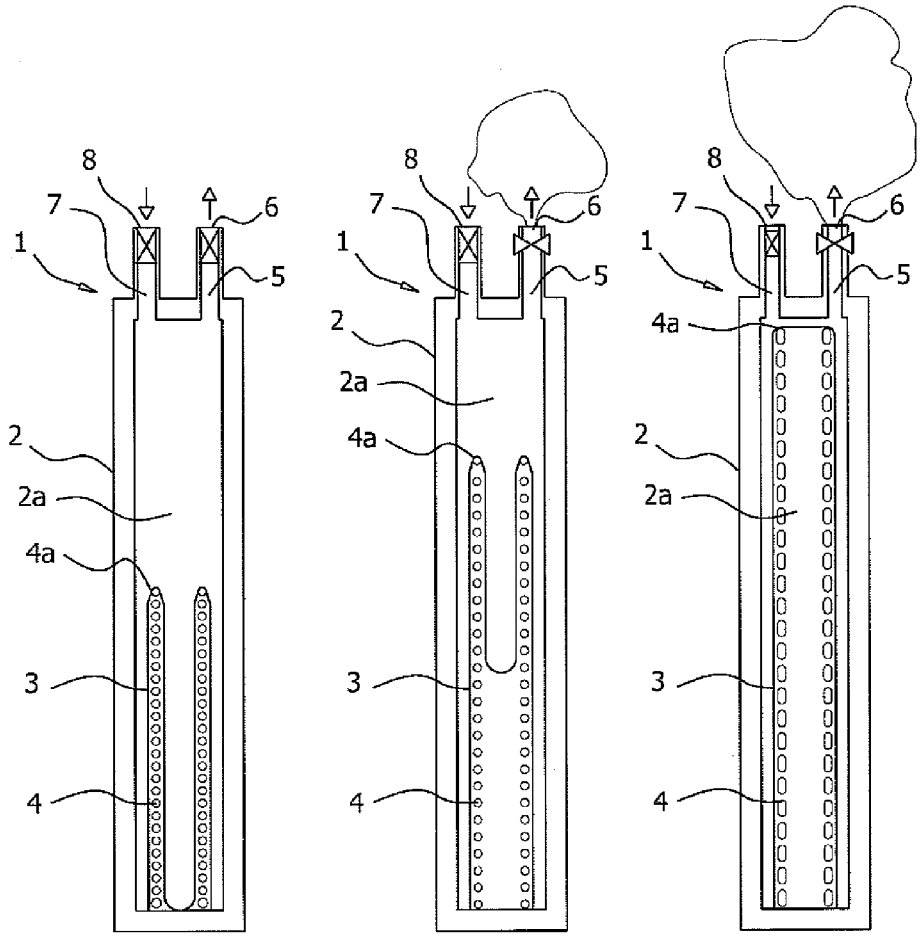
FIGS. 1A-C show in a cross sectional view a fluid reservoir according to the invention having respectively a full, half filled and emptied reservoir.
Figure 2A:
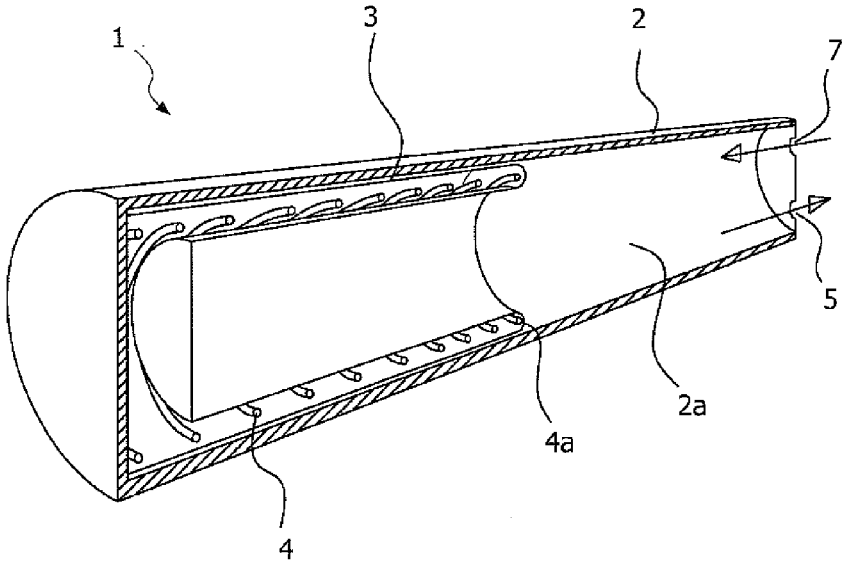
FIGS. 2A and 2B show in a perspective cross sectional view the fluid reservoir as shown in FIGS. 1A and 1B.

FIG. 1A-C show in a cross sectional view a fluid reservoir having respectively a full, half filled and emptied reservoir;

FIG. 1A shows a fully filled fluid reservoir 1 according to the invention. FIG. 2A shows the same fully filled fluid reservoir in a cross sectional perspective view. The fully filled reservoir 1 defines a maximum storage volume. The fluid reservoir has a longitudinal cylindrical housing 2. The housing 2 is tubular. The housing 2 has a closed bottom.

A membrane 3 is disposed inside a cavity of the housing. The membrane 3 delimits a storage volume 2*a* within the cavity of the housing. The volume above the membrane serves as the storage volume. The membrane is flexible. The membrane has a circular cross section and is connected at its outer edge to the bottom of the housing 2.

The membrane covers a biasing member 4. The biasing member 4 is a coil spring. The coil spring is shown in FIGS. 1A and 2A in a fully compressed condition. The coil spring is supported at its foot. The flexible member 3 covers a free end of the coil spring. A ring may be provided at the free end of the coil spring in between the coil spring and the membrane to provide a smooth edge which may come into contact with the membrane. Along its center line the coil spring has a through hole. The through hole defines a recess in the biasing member. The through hole defines a recess with a height which equals the total height of the biasing member. The flexible membrane 3 has a central part which extends from above into the through hole. The introduced part of the flexible membrane 3 defines a partial volume which is part of the storage volume of the fluid reservoir 1. As appears from FIG. 1A, which shows a fully filled reservoir, the storage volume 2*a* for storing fluid extends over substantially the whole length of the housing 2. By virtue thereof, the available space inside the housing is effectively used as a storage volume.

An output port 5 is provided at the upper region of the housing 2. The output port 5 is in fluid communication with the storage volume 2*a*. A valve 6 is connected to the output port 5 for opening or closing the output port. The valve 6 may be actuated electrically or manually by a user. The fluid is pressurized in the storage volume 2*a* by the biasing member which forces the membrane in an upward direction. The pressurized fluid will be released from the storage volume 2*a* when the output port 5 is opened.

Further, the fluid reservoir is provided with an input port 7. The input port is connected with a valve for opening or closing the input port. The input port may be used to refill the fluid reservoir.

Figure 2B:
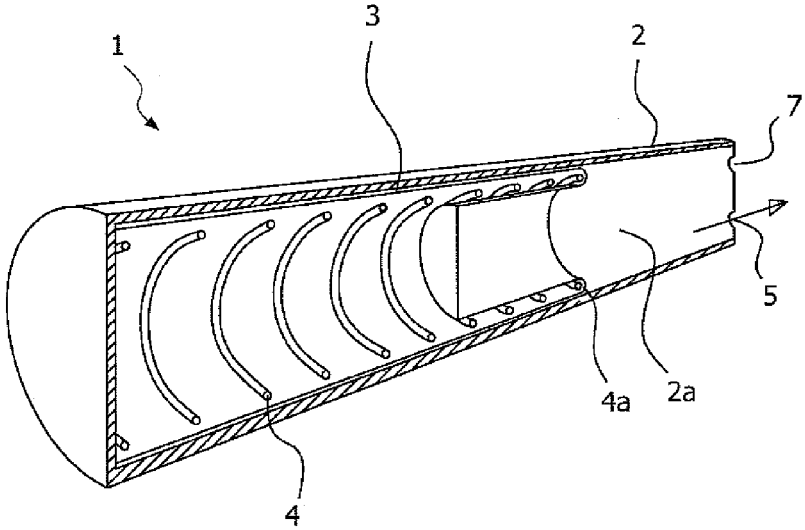

FIG. 1B shows the fluid reservoir according to the invention having the membrane 3 in an intermediate position. FIG. 2B shows the same fluid reservoir in a cross sectional perspective view. In comparison with FIG. 1A, the free end of the coil spring 4 and a central part of the membrane 3 have moved upwards. About half the total volume of the storage volume has been emptied. The central part of the membrane has moved upwards from the bottom of the housing 2 over about a half length of the housing up to about the middle of the housing 2. The free end of the coil spring 4*a* has moved upwards over a stroke of about a quarter of the length of the housing. Hence, the central part moves over a distance approximately twice the stroke of the coil spring. In this configuration, the stroke of the coil spring 4 is limited, which limits the reduction of pretension on the membrane 3. The reduction of pressure in the storage volume 2*a* will be relatively low, which may result in a more constant release of fluid out of the output port 5.

FIG. 1C shows an emptied fluid reservoir. Substantially all the fluid has been released from the fluid reservoir via the output port. The coil spring 4 has been decompressed over a full stroke. In comparison with FIG. 1A, the compression stroke of the coil spring corresponds with about half the length of the housing 2. The central part of the membrane 3 has also reached an end position. The membrane has been expanded in upward direction. The central part of the membrane has been moved over a stroke which corresponds with about the whole length of the housing.

Figure 3A:
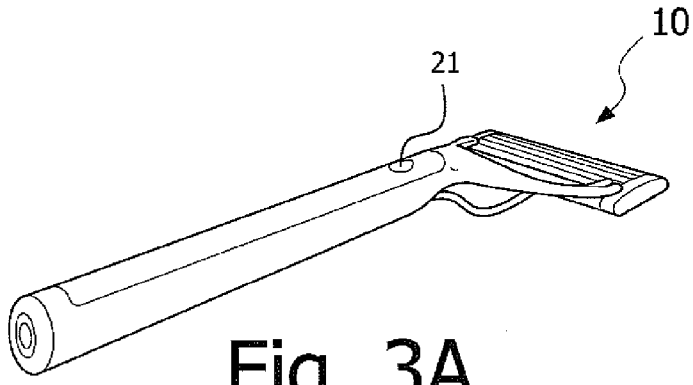
FIG. 3A shows in a perspective view a razor as a handheld device according to the invention.
Figure 3B:
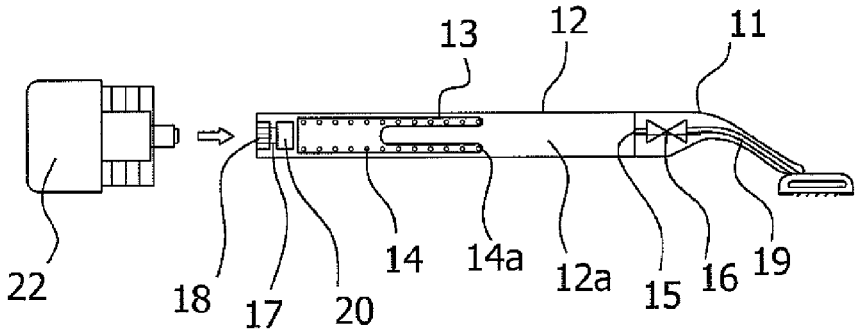
FIG. 3B shows in a cross sectional view an implementation of the fluid reservoir in a razor.

FIG. 3A shows in a perspective view a razor as a handheld device according to the invention, which is further elucidated in FIG. 3B.

FIG. 3B shows in a cross sectional view an implementation of the fluid reservoir in a razor 10. The razor has a razor blade cartridge 23 at the distal end of a handle 11. The handle 11 has a cavity which extends in the length direction of the razor. A fluid reservoir, which has been shown in FIG. 1 and FIG. 2, is integrated in the razor 10. The cavity in the handle is effectively used and defines a housing 12 including a storage volume 12*a* for a fluid, for instance a shaving additive, which is delimited by a membrane 13. The fluid reservoir may have a length of about 10 cm wherein a maximum storage volume extends over at least 80% of the total length. A coil spring 12 is provided for biasing the membrane 13. At the proximal end of the handle 11, the razor includes a battery 20. The battery 20 may be used to electrically activate a valve 16 which opens an output port 15. A button 21 may be ergonomically provided close to the distal end at the outer surface to operate the valve 16. A sleeve 19 may be provided for transferring a fluid, like a shaving additive, from the handle to a razor blade cartridge 23 at the distal end of the razor.

Further, a valve 18 and an inlet port 17 are provided at the proximal end of the handle. A refill bottle 22 may be connected to the inlet port 17 for filling the fluid reservoir. A fluid channel (not shown) may be provided which extends from the proximal end of the handle to the distal end. The fluid channel may be in fluid communication with the inlet port 17 and the storage volume 12*a* for transporting a fluid from the refill bottle to the storage volume 12*a*. By connecting the refill bottle and opening the inlet port 17, a fluid may be transported to the storage volume 12*a*.

Although this invention has been shown and described with respect to detailed embodiments thereof, it will be understood by those of skill in the art that various changes may be made and equivalents may be substituted for elements thereof without departing from the scope of the invention. For instance, although the Detailed Description describes the biasing member in terms of a coil spring, numerous other types of biasing members are capable. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

The invention claimed is:

1. A reservoir for a handheld device for personal care for storing a fluid, the reservoir comprising:

a housing configured to enclose a storage volume and having proximal and distal ends;

a membrane having an open end connected to the proximal end and a closed end for delimiting the storage volume;

an output port at the distal end in fluid communication with the storage volume for dispensing the fluid;

a forcing member connected inside the membrane to the proximal end and configured to exert a force on the closed end of the membrane to pressurize a fluid in the storage volume, wherein the forcing member has a recess for receiving a part of the storage volume.

2. The reservoir according to claim 1, wherein the membrane is deformable due to a fluid pressure in the storage volume, the membrane being received into the recess to enlarge a maximum storage volume by at least 20%.

3. The reservoir according to claim 1, wherein the forcing member is a biasing member exerting a pre-load force on the membrane.

4. The reservoir according to claim 3, wherein the biasing member is a coil spring.

5. The reservoir according to claim 1, wherein the housing includes an inner wall and the membrane is connected to the inner wall of the housing at the proximal end.

6. The reservoir according to claim 1, wherein the membrane is flexible due to a rolling deformation.

7. The reservoir according to claim 1, wherein the membrane is positioned opposite the output port.

8. The reservoir according to claim 1, wherein the housing comprises an input port for re-filling the fluid in the reservoir.

9. The reservoir according to claim 8, wherein the housing includes an external surface and the input port is situated adjacent the output port at the external surface of the housing.

10. The reservoir according to claim 1, further comprising a refill reservoir and a connector provided at the input port for connecting to the refill reservoir.

11. The reservoir according to claim 1, further comprising a passage channel in fluid communication with the storage volume and the input port.

12. The reservoir according to claim 1, wherein the fluid reservoir is a removable cartridge.

13. The reservoir according to claim 1, wherein the housing is a handle.

14. The reservoir according to claim 1, wherein the hand-held device is selected from one of a shaving device, a trimmer, a toothbrush or a skincare product.

15. The reservoir according to claim 14, further having a handle comprising a cavity defining the housing.

* * * * *